US011112226B2

(12) United States Patent
Razmus, II et al.

(10) Patent No.: US 11,112,226 B2
(45) **Date of Patent: *Sep. 7, 2021**

(54) BOWFISHING ARROW WITH A QUICK-RELEASE ARROWHEAD

(71) Applicants: John Razmus, II, Westville, IL (US); Robert Cope, Westville, IL (US)

(72) Inventors: John Razmus, II, Westville, IL (US); Robert Cope, Westville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/725,900

(22) Filed: Dec. 23, 2019

(65) Prior Publication Data

US 2020/0132423 A1 Apr. 30, 2020

Related U.S. Application Data

(63) Continuation of application No. 14/949,497, filed on Nov. 23, 2015, now Pat. No. 10,514,238.

(60) Provisional application No. 62/083,154, filed on Nov. 21, 2014.

(51) Int. Cl.
*F42B 6/08* (2006.01)

(52) U.S. Cl.
CPC ..... *F42B 6/08* (2013.01)

(58) Field of Classification Search
CPC .... F42B 6/003; F42B 6/08; F42B 6/04; F42B 12/362; F42B 6/02
See application file for complete search history.

(56) References Cited

U.S. PATENT DOCUMENTS 362,183 A * 5/1887 Bunyon ..... E02D 5/803 52/162
1,113,465 A * 10/1914 Moller ..... B67B 7/12 81/3.49
2,455,784 A * 12/1948 Lapsensohn ..... A01K 81/00 43/6
2,859,970 A * 11/1958 Doonan ..... F42B 6/08 473/583
2,939,708 A * 6/1960 Scheib ..... F42B 6/08 473/582
3,036,395 A * 5/1962 Nelson ..... F42B 30/14 43/6
3,036,396 A * 5/1962 Swails ..... F42B 6/08 43/6
3,393,912 A * 7/1968 De Lonais ..... F42B 12/362 473/581
3,738,657 A * 6/1973 Cox ..... F42B 6/08 473/585

(Continued)

*Primary Examiner* — Melba Bumgarner
*Assistant Examiner* — Amir A Klayman
(74) *Attorney, Agent, or Firm* — K&L Gates LLP

(57) ABSTRACT

An arrow comprising: an arrow shaft including a toggle movable between a first state and a second state; an arrowhead including an arrowhead body and an arrowhead tip, wherein the arrowhead body includes a first end and a second end, the second end being attached to the arrow shaft; and at least one barb vane including a first end and a second end, the first end being pivotally mounted to the arrowhead body at a pivot, wherein the barb vane is pivotably movable between a first configuration and second configuration; wherein, when the toggle is in the first state, the barb vane is locked in the first configuration and, when the toggle is in the second state, the barb vane is permitted to move freely into the second configuration.

6 Claims, 12 Drawing Sheets

(56) References Cited

U.S. PATENT DOCUMENTS 3,759,519 A * 9/1973 Palma ..... F42B 12/362 473/578
4,024,665 A * 5/1977 Payne ..... A01K 81/00 43/6
4,807,382 A * 2/1989 Albrecht ..... A01K 81/00 43/6
4,940,246 A * 7/1990 Stagg ..... F42B 6/08 473/583
5,033,220 A * 7/1991 Phelps ..... A01K 81/04 43/6
5,314,196 A * 5/1994 Ruelle ..... F42B 6/04 473/578
6,186,913 B1 * 2/2001 Thomas ..... F42B 12/362 473/581
6,554,727 B1 * 4/2003 Armstrong ..... F42B 6/08 473/583
7,485,056 B2 * 2/2009 Sullivan ..... F42B 6/08 473/583
8,016,704 B1 * 9/2011 Vandewater ..... F42B 6/08 473/583
8,414,432 B1 * 4/2013 Hand ..... F42B 6/04 473/583
9,526,234 B2 * 12/2016 Harshberger ..... A01K 81/00
9,723,820 B2 * 8/2017 Harshberger ..... A01K 99/00
9,907,298 B2 * 3/2018 White ..... A01K 81/04
10,295,321 B2 * 5/2019 Braden ..... F42B 6/04
10,619,982 B2 * 4/2020 Romero ..... F42B 6/08
2009/0203477 A1 * 8/2009 Mizek ..... F42B 6/08 473/583
2010/0004078 A1 * 1/2010 Flanagan ..... F42B 6/08 473/583
2010/0173734 A1 * 7/2010 Robbins ..... F42B 6/08 473/584
2014/0128186 A1 * 5/2014 Treto ..... F42B 6/08 473/583
2017/0172123 A1 * 6/2017 Sullivan ..... A01K 81/04

* cited by examiner

BOWFISHING ARROW WITH A QUICK-RELEASE ARROWHEAD

CROSS-REFERENCE TO RELATED APPLICATIONS

This application incorporates by reference and claims the benefit of priority to U.S. Provisional Patent Application No. 62/083,154 filed Nov. 21, 2014.

BACKGROUND OF THE INVENTION

The present invention relates to a bowfishing arrow with a quick-release arrowhead. More specifically, the present invention provides a quick-release bowfishing arrow including a toggle mechanism in the rear portion of the arrow's shaft for releasing the arrowhead.

Bowfishing is a sport in which a bowfisher uses specialized archery equipment to shoot and retrieve fish. The standard bowfishing rig includes a barbed arrow that is attached to a reel on a bow using an appropriate length and strength of bowfishing line.

The line is typically made from a braided polymer for strength, flexibility, and durability; the reel can be a hand-wrap, spincast, retriever, or any other appropriate reel; the bow is typically a simplified traditional or compound bowl; and the arrows are typically relatively heavy, made from fiberglass, aluminum, carbon fiber, or carbon fiber reinforced fiberglass, lack fletching, and have a hole in the shaft through which the line is attached. The arrows may further include a set of pivoting barb vanes (typically two) at the arrowhead.

The barb vanes are often a pair broad, angled, metal elements that, in an initial position, angle away from the arrowhead towards the arrow's shaft to catch in the target fish after impact, making it difficult for the arrowhead to become unintentionally dislodged. Once the bowfisher retrieves a fish that has been shot with such an arrow, the bowfisher must then reorient the barb vanes to point towards the arrowhead in order to more easily remove the arrowhead from the fish. This is a manual task that requires the bowfisher to reach into the target fish, manipulate the barb vanes and/or partially unscrew the arrowhead, and then remove the arrow. This task is performed under conditions that can be messy, slippery, where the barb vanes and arrowhead may be difficult to see, all while trying to maintain control of an uncooperative fish. The task is dangerous because the bowfisher is reaching towards sharp arrowhead under these adverse conditions. Accidents are inevitable and can be traumatic.

Accordingly, there is a need for a bowfishing arrow that allows a user to more easily remove the arrowhead from the target, as described and illustrated herein.

BRIEF SUMMARY OF THE INVENTION

The present invention solves the above-mentioned problems by providing a quick-release bowfishing arrow including a barb vane toggle mechanism that is located in the rear portion of the arrow's shaft.

Specifically, the present system provides a bowfishing arrow having spring-biased barb vanes manipulable between a first position and a second position using a toggle located towards the rear of the arrow shaft. A two-position, hook-shaped, toggle enables the user to conveniently select the position of the barb vanes without being in close proximity to the arrowhead.

In one embodiment, the bowfishing arrow includes an arrowhead including a pair of angled barb vanes manipulable between a first (deployed) position and a second (retracted) position. The barb vanes are located within an L-shaped slot in the arrowhead, with the vertical portion of the L extending along the axial length of the arrowhead and the horizontal portion of the L wrapping around the diameter of the arrowhead.

The barb vanes may be connected to a toggle located near the rear of the arrow shaft. The toggle may be located within a hook-shaped slot (e.g., generally U-shaped with one side of the U longer than the other and the U facing towards the rear of the arrow) such that the toggle can be secured at either end of the hook and the barb vanes will move between positions as well. For example, when the toggle is located in the shorter of the two sides of the hook, the barb vanes may be in their deployed position and, when the toggle is located in the longer of the two sides of the hook, the barb vanes may be in their retracted position.

A spring mechanism may be located within the arrowhead to act on the barb vanes to bias the barb vanes away from the tip of the arrowhead. Because the toggle travels within a hook shaped slot, the spring mechanism is able to "lock" the position of the barb vanes in either the deployed or retracted position.

When in the retracted position, the barb vanes retract into the body of the arrowhead, reducing the distance they extend from the arrowhead. The barb vanes also angle more towards the tip of the arrow than the shaft, which makes the barb vanes easier to remove the from the target fish.

In another embodiment, an arrow tip shaft may protrude out of the arrow tip such that it can slide into the arrowhead and arrow shaft. The arrow tip shaft may be connected to the toggle mechanism, such that the toggle mechanism can slide and move the arrow tip shaft within the arrow shaft along the arrow axis. When the toggle mechanism is secured in the deployed position, the arrow tip is flush with the arrowhead such that no gap exists between the arrow tip and arrowhead. When the toggle mechanism is secured in the extraction position a spaced in introduced between the arrow tip and arrowhead, which may expose the arrow tip shaft. This space allows the barb veins to angle more towards the tip of the arrow than the arrow shaft, which makes the barb vanes easier to remove the from the target fish.

In another embodiment, the toggle mechanism is an electronic or pneumatic automated mechanism that toggles the barb vanes between the deployed and retracted positions. For example, the toggle mechanism may be a simple electronic switch that replaces the physical toggle and U-shaped slot.

In an embodiment, an arrow includes: an arrow shaft including a toggle movable between a first state and a second state; an arrowhead including an arrowhead body and an arrowhead tip, wherein the arrowhead body includes a first end and a second end, the second end being attached to the arrow shaft; and at least one barb vane including a first end and a second end, the first end being pivotally mounted to the arrowhead body at a pivot, wherein the barb vane is pivotably movable between a first configuration and second configuration; wherein, when the toggle is in the first state, the barb vane is locked in the first configuration and, when the toggle is in the second state, the barb vane is permitted to move freely into the second configuration.

In an embodiment, the pivot is the vertex of an angle defined by a ray of the pivot to the second end of the barb vane and the pivot to the arrow shaft, wherein the angle of the first configuration is less than the angle of the second configuration. And, in an embodiment, the angle of the first configuration is ninety degrees or less and the angle of the second configuration is greater than ninety degrees.

In some embodiments, when the toggle is in the first state, the barb vane is locked in the first configuration because the base portion of the arrow tip prevents the full rotation of the barb vane into the removable position. And in some embodiments, the arrowhead body includes at least one axial slot in the arrowhead body, wherein at least one barb is located within at least one slot. Additionally, in some embodiments, the toggle mechanism includes an L-shaped slot.

In some embodiments, the toggle is a mechanical mechanism. And, in some embodiments, the toggle is an electric mechanism. Additionally, in some embodiments, the arrow further includes a mechanical linkage joining the toggle and arrowhead tip located within the arrow shaft. Further, in some embodiments, the arrow further includes a mechanical linkage joining the toggle and barbs located within to the arrow shaft.

In some embodiments, the arrow further including a linkage between the toggle and barbs located external to the arrow shaft. And in some embodiments, the toggle mechanism is located at approximately the midpoint of the shaft.

Further, in some embodiments, the toggle mechanism is located on the shaft between two to four inches distal from arrowhead.

In an embodiment, an arrow includes: an arrow shaft including a toggle movable between a first state and a second state; an arrowhead including an arrowhead body and an arrowhead tip, wherein the arrowhead body extends along an arrow axis between a first end and a second end, the second end being attached to the arrow shaft; at least one barb vane including a first end and a second end, the first end being pivotally mounted to a movable toggle piston, wherein the toggle piston is connected to the toggle, wherein the barb vane is pivotably movable between a first configuration and second configuration; wherein, when the toggle is in the first state, the barb vane is locked in the first configuration and, when the toggle is in the second state, the barb vane is permitted to move freely into the second configuration.

An advantage of the present design is it provides a quick-release bowfishing arrowhead.

Another advantage of the present design is it reduces the risk of injury to the bowfisher when removing the arrow from the fish.

A further advantage of the present design is it provides a more convenient toggle mechanism for manipulating the position of the barb vanes.

Yet another advantage of the present design is it provides a more stable arrowhead in that the arrowhead does not need to be partially unscrewed to manipulate the position of the barb vanes.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
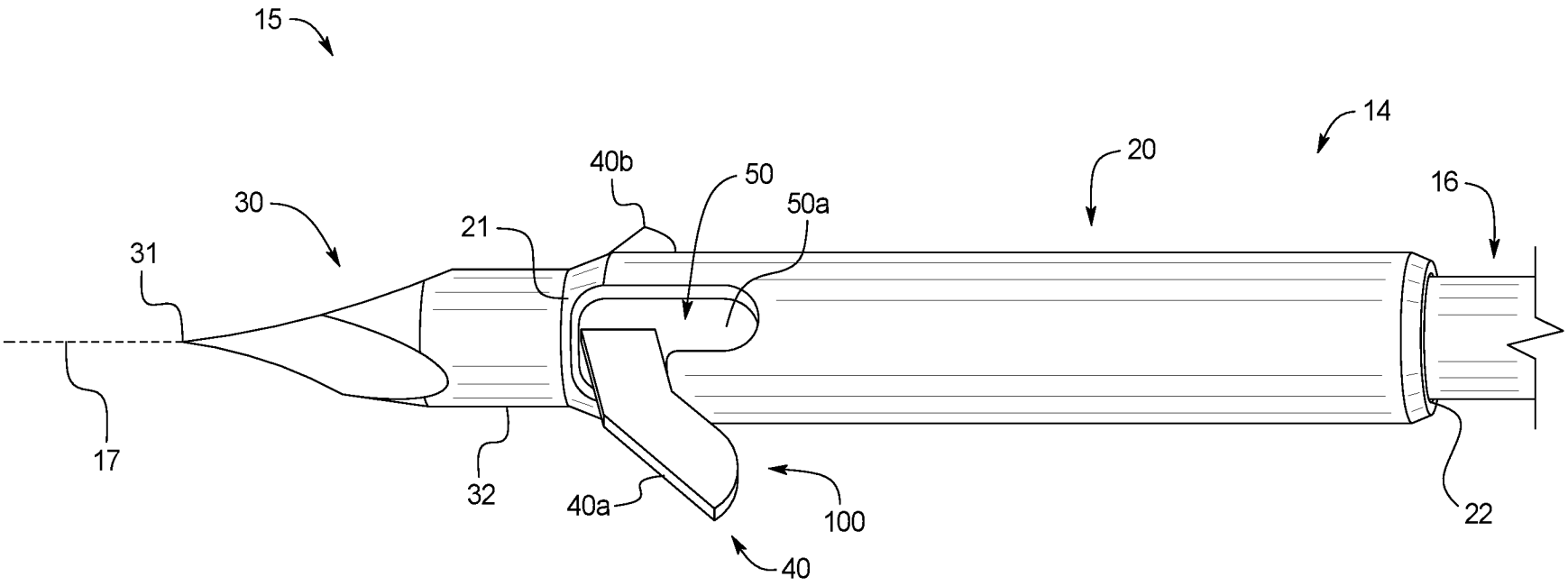
FIG. 1 is a side view of an example arrowhead with barbs in a deployed position.

FIG. 1 illustrates an arrow 14 with a quick-release arrowhead 15 in accordance with one possible embodiment of the present invention. The arrow 14 includes an arrow shaft 16 attached to the arrowhead 15. As shown in FIG. 1, the arrowhead 15 includes an arrowhead body 20 and an arrow tip 30.

In an embodiment, the arrowhead body 20 includes a front end 21 and back end 22. The arrowhead body 20 may be made from fiberglass, aluminum, carbon fiber, or carbon fiber reinforced fiberglass. The arrowhead body back end 22 may attach to the arrow shaft 16.

The arrowhead body 20 may include one or more angled barbs 40. The barbs 40 operate to prevent the disengagement of the arrowhead 15 by a prey fish. The outside edge of the arrowhead body 20 may provide for one or more axial slots 50, which are cut into the arrowhead body 20. The arrowhead body 20 may include an identical number of barbs 40 and slots 50. The barbs 40 may be movable between an extended configuration for firing and a retracted configuration for removal from the fish.

The arrow tip 30 includes a base portion 32 that tapers to a penetrating point 31. The arrow tip 30 may be attached to the arrowhead body front end 21, for example, by threading onto a threaded stud extending from the arrowhead body 20. The arrow tip base portion 32 may be generally cylindrical in shape. The arrow tip penetrating point 31 is generally aligned with the arrow axis 17.

FIGS. 1, 2, 3, 4, and 5 illustrate one possible embodiment of the present invention. As shown in FIG. 1, in an embodiment, the arrowhead body 20 may provide two angled barbs, first barb 40*a* and second barb 40*b*. The outside edge of the arrowhead body 20 may provide for two axial L-shaped slots, a first slot 50*a* and a second slot 50*b*, with the vertical portion of the L extending along the axial length of the arrowhead 20 and the horizontal portion of the L wrapping around the diameter of the arrowhead 20. Barb 40*a* may be located within L-shaped slot 50*a* and barb 40*b* may be located within L-shaped slot 50*b*.

As shown in FIG. 1, when the barbs 40*a* and 40*b* are in a deployed position 100, barbs 40*a* and 40*b* angle away from the arrowhead body 20 towards the arrow shaft 16. In the deployed position 100, the barbs 40*a* and 40*b* are located within the horizontal portion of the L-shape slots 50*a* and 50*b*.

Figure 2:
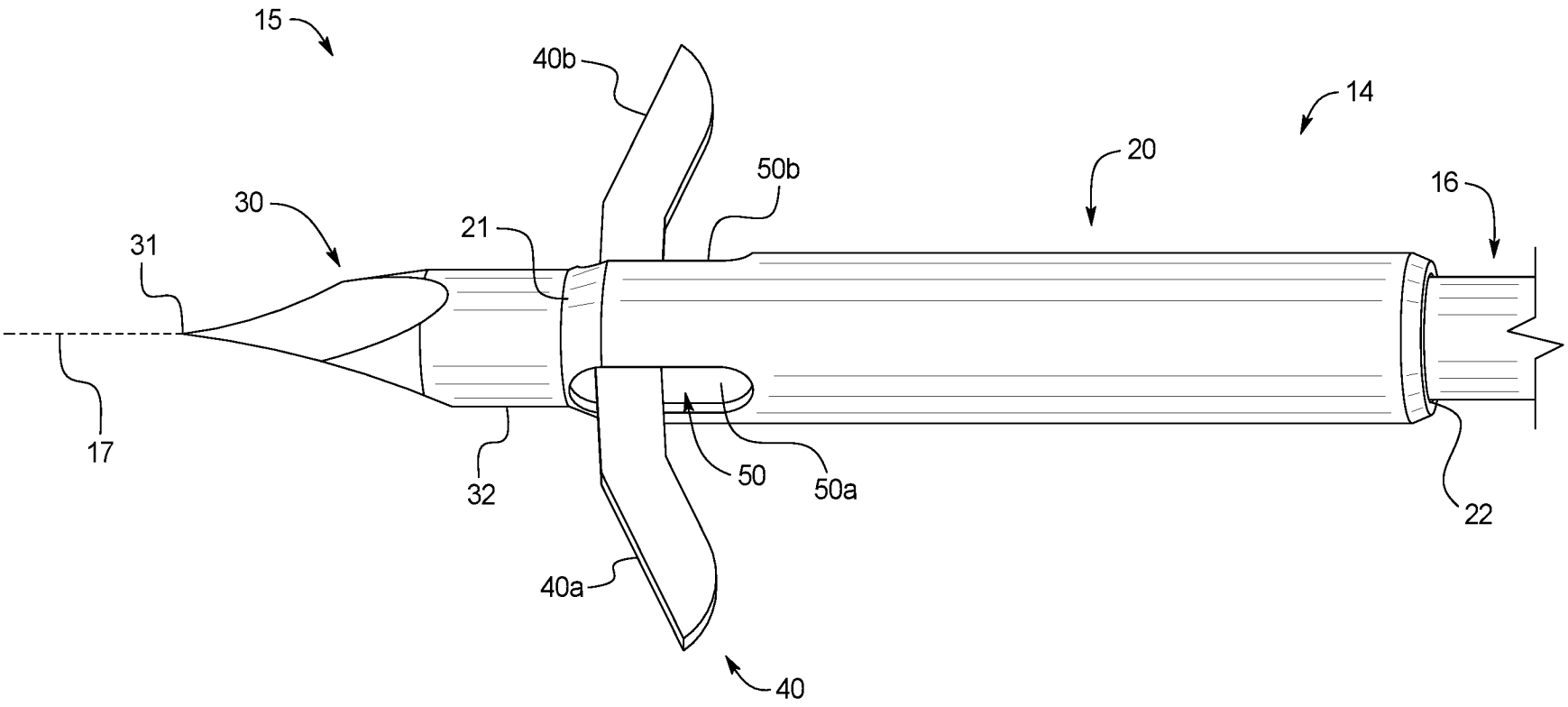
FIG. 2 is a top perspective view of the embodiment of FIG. 1 with the barbs in a deployed position.
Figure 3:
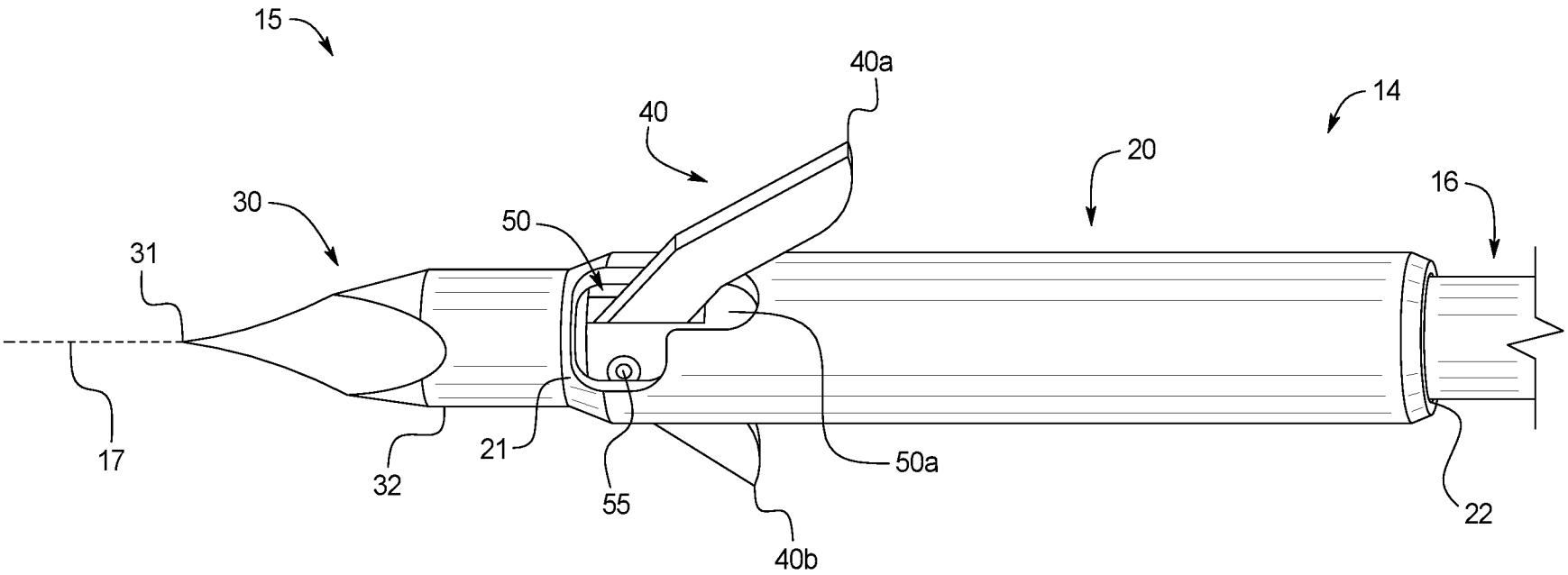
FIG. 3 is a side perspective view illustrating the barbs in a loosened position along with a spring mechanism located within the arrowhead.
Figure 4:
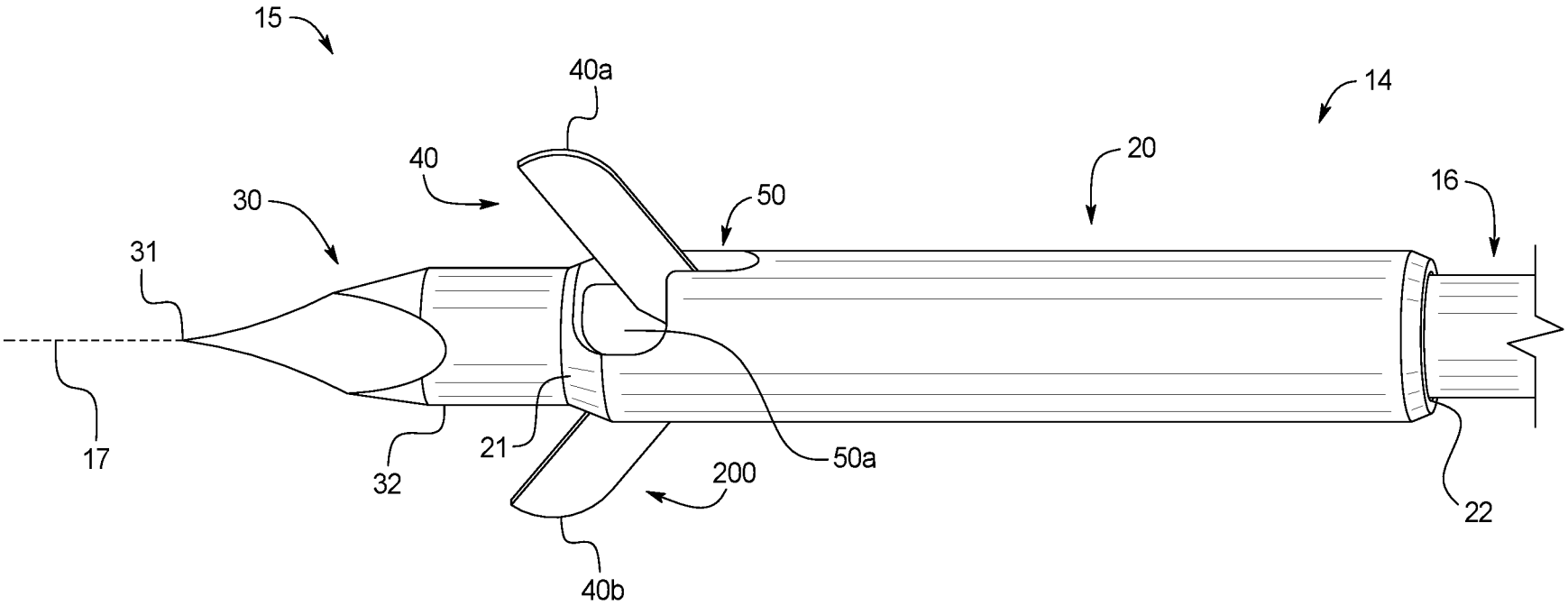
FIG. 4 is a side perspective view of the embodiment of FIG. 1 illustrating the barbs in a retracted position.
Figure 5:
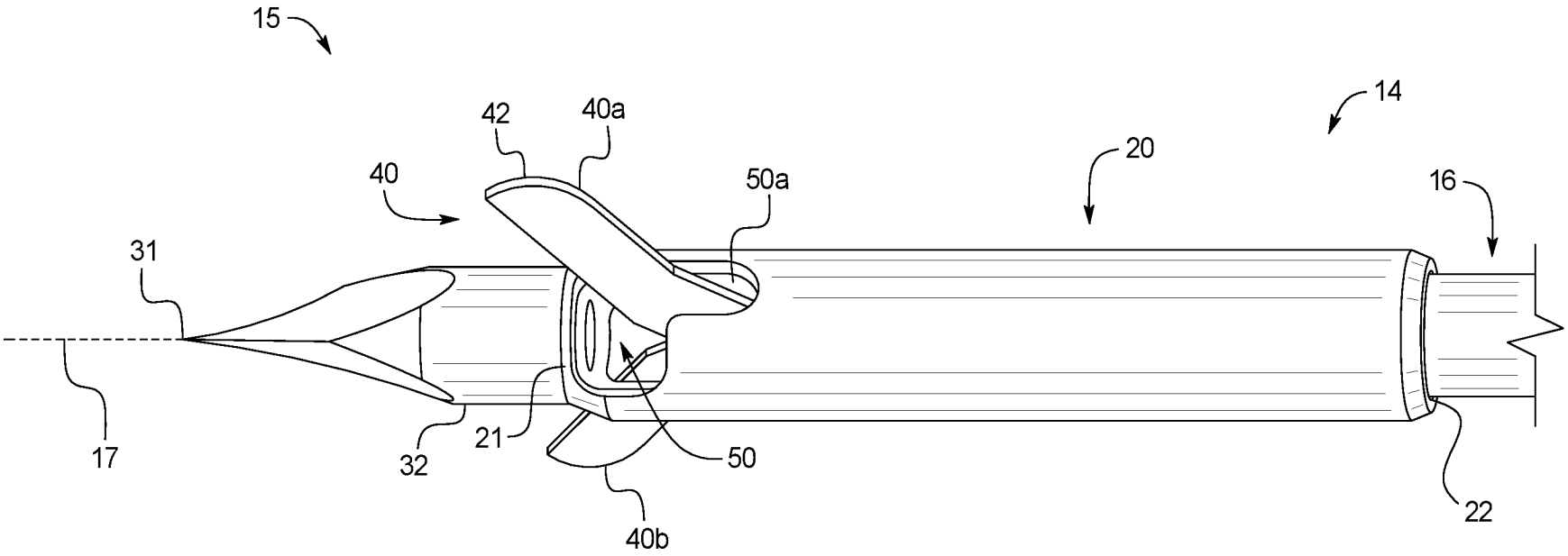
FIG. 5 is a side perspective view of the embodiment of FIG. 1 illustrating the detail of the barbs in a retracted position.

FIGS. 2 and 3 illustrates one possible embodiment of the arrowhead body 20 and the barbs 40*a* and 40*b* as they transition to a retracted position 200, as shown in FIG. 4. The barbs 40*a* and 40*b* rotate around the arrow axis 17 within the L-shaped slots 50*a* and 50*b* such that they are located within the vertical portion of the L-shaped slots 50*a* and 50*b*. As illustrated in FIG. 3, the spring mechanism 55 may be located within the arrowhead body 20 to act on the barbs 40*a* and 40*b* to bias barbs 40*a* and 40*b* away from the arrow tip 30. The spring mechanism 55 is able to lock the position of barbs 40*a* and 40*b* in either the deployed position 100 as in FIG. 1 or the retracted position 200 as in FIGS. 4 and 5. As shown in FIGS. 4 and 5, when barbs 40*a* and 40*b* are in the retracted position 200, they retract into the arrowhead body 20, thus reducing the distance they extend from the arrowhead body 20. The barbs 40*a* and 40*b* may also angle more towards the penetrating tip 31 of the arrow tip 30 than the arrow shaft 16, making them easier to remove from the target fish.

Figure 6:
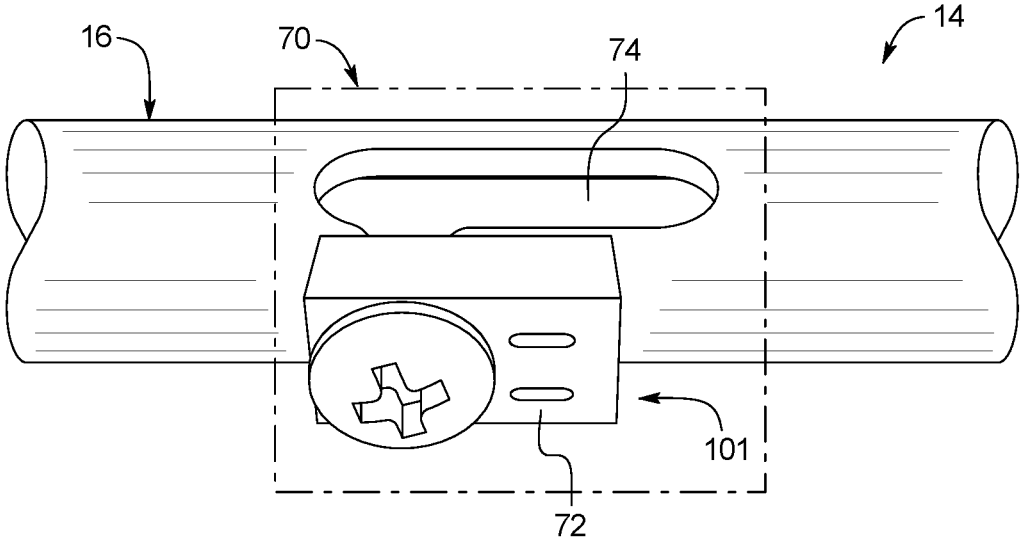
FIG. 6 is a side view of a toggle mechanism in a first position.
Figure 7:
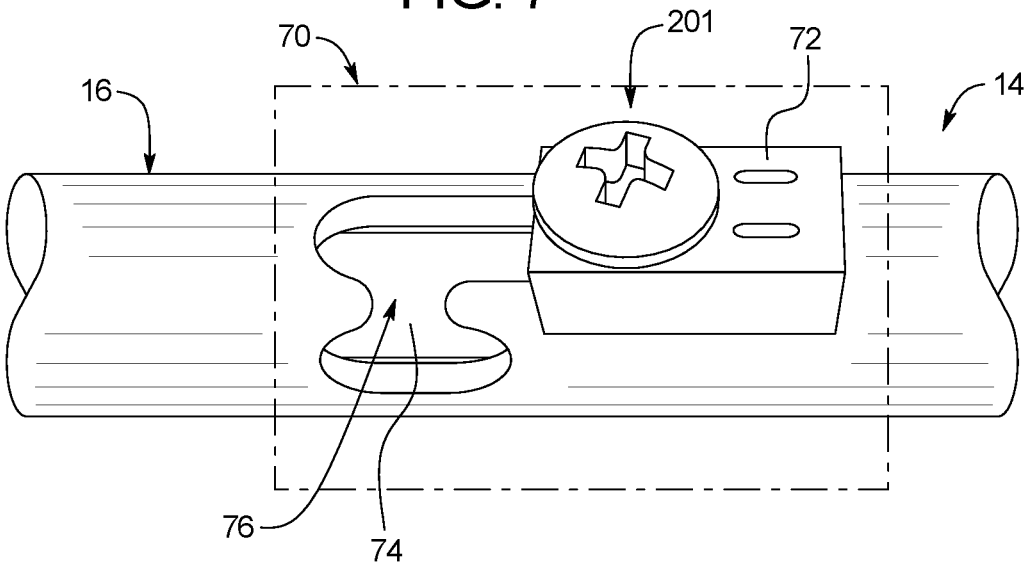
FIG. 7 is similar to that of FIG. 6 showing the toggle mechanism in a second position.

FIGS. 6 and 7 illustrate a toggle 70 in accordance with one possible embodiment of the present invention. As shown in FIGS. 6 and 7, the toggle 70 includes a toggle 72 and toggle slot 74. In an embodiment, the toggle 70 may be located near the rear of the shaft 16. FIG. 6 illustrates the toggle 72 positioned for firing. FIG. 7 illustrates the toggle 72 positioned for removal.

The toggle 72 is located within the toggle slot 74. The toggle slot 74 may be L-shaped or U-shaped. The toggle 72 can be secured at either end of the toggle slot 74. Each secured position of the toggle 72 corresponds to a position of the barbs 40. In one example, when the toggle 72 is located in the shorter of the two sides of the hook-shaped toggle slot 74 as shown in FIG. 6, the barbs 40 may be in their deployed position 100 for firing. Similarly, when the toggle 72 is located in the longer of the two sides of the hook-shaped toggle slot 74 as shown in FIG. 7, the barbs 40 may be in their retracted position 200 for removal from the fish. The toggle slot 74 may include a transition lock 76 formed by protrusions on both sides of the toggle slot 74 between the deployed toggle position and the retracted toggle position to lock the toggle 72 into the deployed toggle position for firing.

In one possible embodiment, as shown in FIGS. 6 and 7, the toggle 72 is located within a U-shaped toggle slot 74, with one side of the "U" being longer than the other and the "U" facing towards the rear of the arrow. The toggle 72 can be secured at either end of the U-shaped toggle slot 74. As illustrated in FIG. 6, when the toggle 72 is in the deployed toggle position 101, it is located in the shorter of the two-sides of the U-shaped toggle slot 74. When the toggle 72 is in the deployed position 101, the barbs 40 are in the deployed position 100. As illustrated in FIG. 7, when the toggle 72 is in a removable toggle position 201, it may be located in the longer of the two sides of the U-shaped toggle slot 74. When the toggle 72 is in the retracted position 201, the barbs 40 are in the retracted position 200.

The toggle 72 may be located at different locations in different embodiments. The location of the toggle 72 may be chosen to best locate the toggle at a natural grip point for the arrow 14. For example, in an embodiment, the toggle 72 is located on the shaft between two to four inches distal from arrowhead 15. This may be useful for arrows 14 that are flexible or lightweight where the user would naturally grab the arrow 14 near the fish. In another embodiment, the toggle 72 may be located at approximately the midpoint of the arrow shaft 16. This may be useful for arrows 14 that have sufficient strength and rigidity for the user to grab the arrow 14 near the center. In further embodiments, the toggle 72 may be located near the rear of the arrow 14 to permit release of the fish from the furthest possible advantage.

The toggle 72 may be connected to the barbs 40 via a toggle piston 76. The toggle piston 76 may span from the toggle 72 to the barbs 40 through an interior axial tube within the shaft 16. The toggle piston 76 may be rigidly attached to the toggle 72 and may move rotationally when the toggle 72 is moved from the deployed toggle position 101 to a loosened position in FIG. 3, and then may move translationally along the axis 17 to move into the retracted toggle position 201. When the toggle 72 is pulled away from the arrowhead to move into the retracted toggle position, the toggle 72 pulls the toggle piston 76 along the inner axial tube pulling the barbs 40 partially into the axial slots 50. Although the toggle piston 76 is described as being provided within an interior axial tube within the shaft 16, it is understood that in other embodiments, the toggle piston 76 may be positioned outside the shaft 16 as will be appreciated by those of skill in the art from the examples provided. Additionally, it will be recognized by those of skill in the art from the examples provided that the toggle piston 76 is just one example of a mechanical linkage that may connect the toggle 72 to the barbs 40.

Although the toggle 72 is rigidly connected to the barbs 40 via a toggle piston in an embodiment, in other embodiments, the toggle 72 may control the positioning of the barbs 40 by a variety of other mechanisms. For example, in other embodiments, the toggle 72 may control the positioning of the barbs 40 electrically, for example, the toggle 72 may control a motor that move the barbs 40 from a deployed position 100 to a retracted position 200. In further embodiments, the arrowhead 15 may include a pneumatic toggle, a hydraulic toggle, etc. Accordingly, in other embodiments, the toggle piston 76 may be replace with cable, string, electrical wiring, etc. to convey electrical or mechanical motion to the barbs 40.

Figure 8:
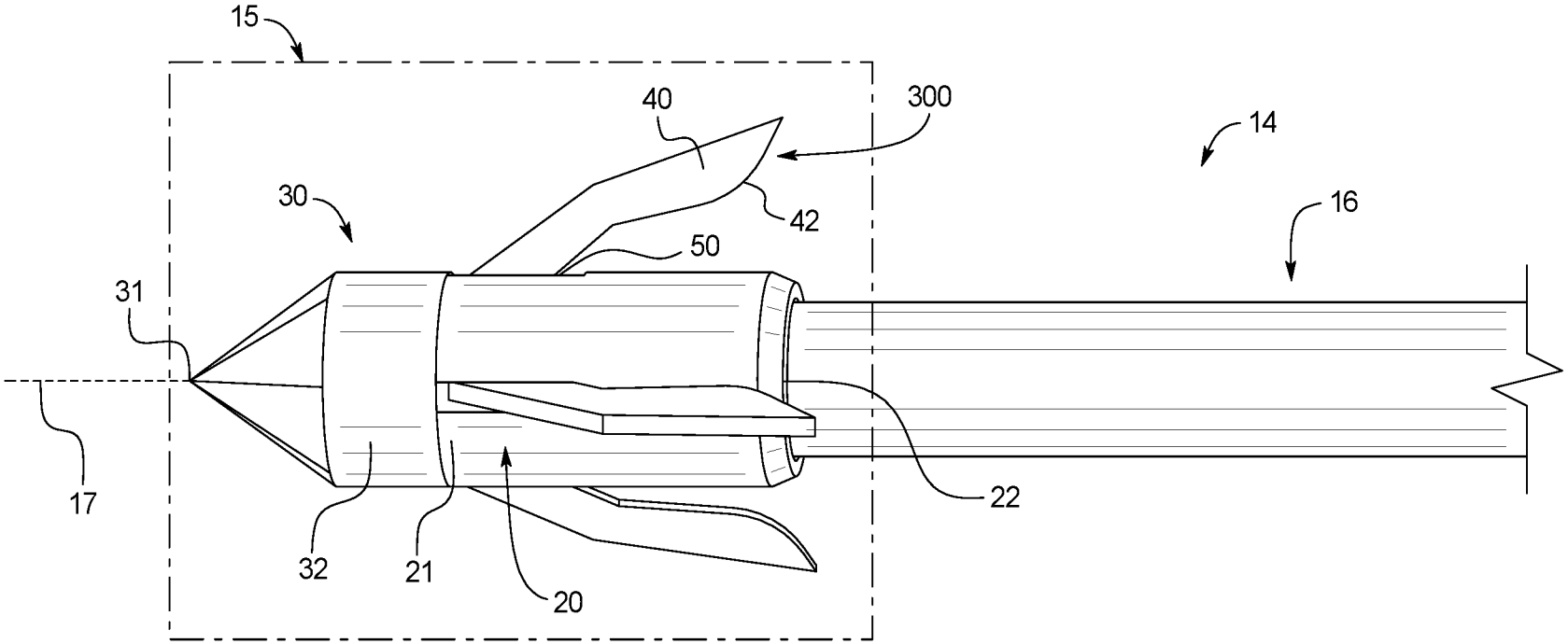
FIG. 8 is a side perspective view of another embodiment of an arrowhead with barbs in a firing position.
Figure 9:
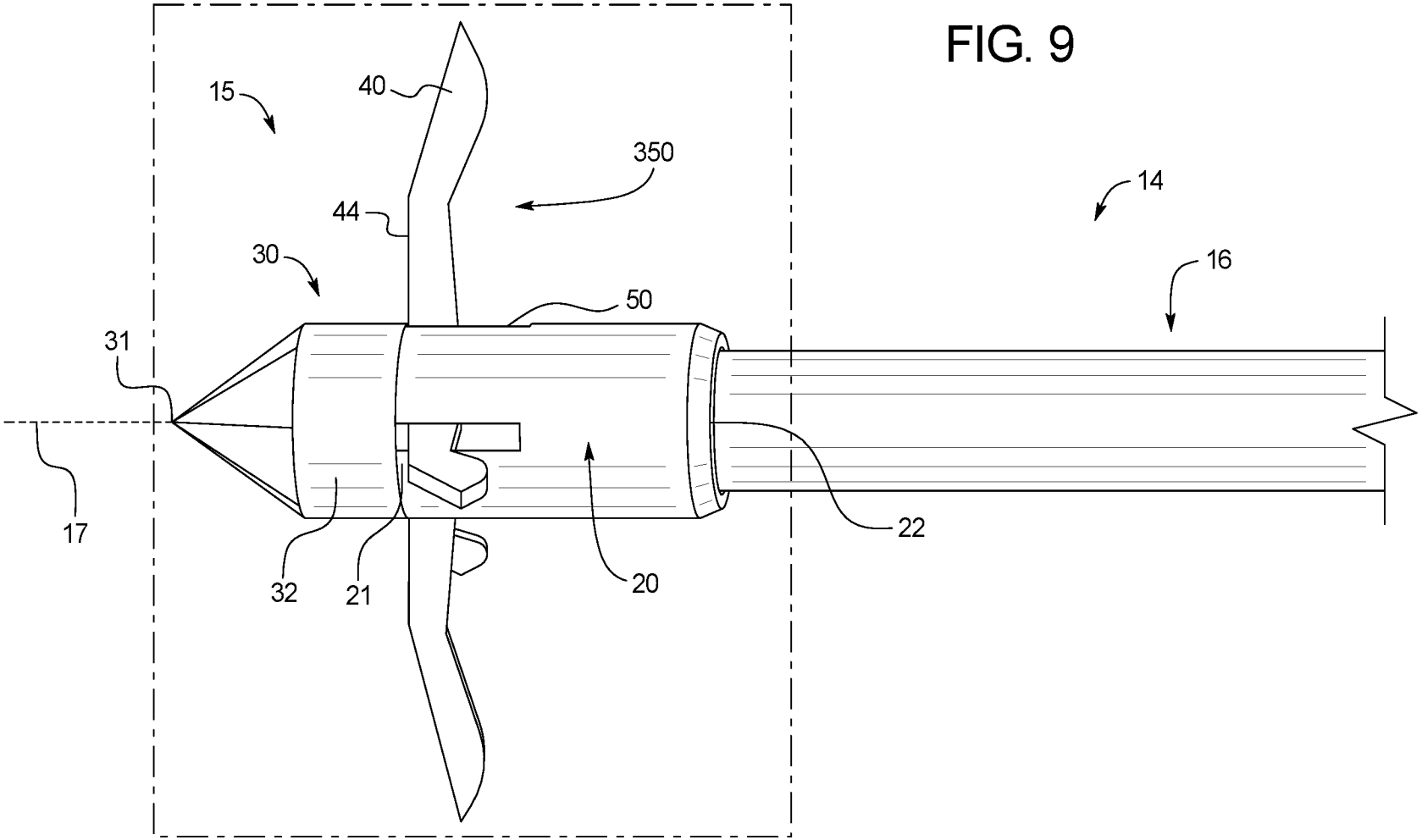
FIG. 9 is a side perspective view of the arrowhead of FIG. 8 illustrating the barbs in a deployed position.
Figure 10:
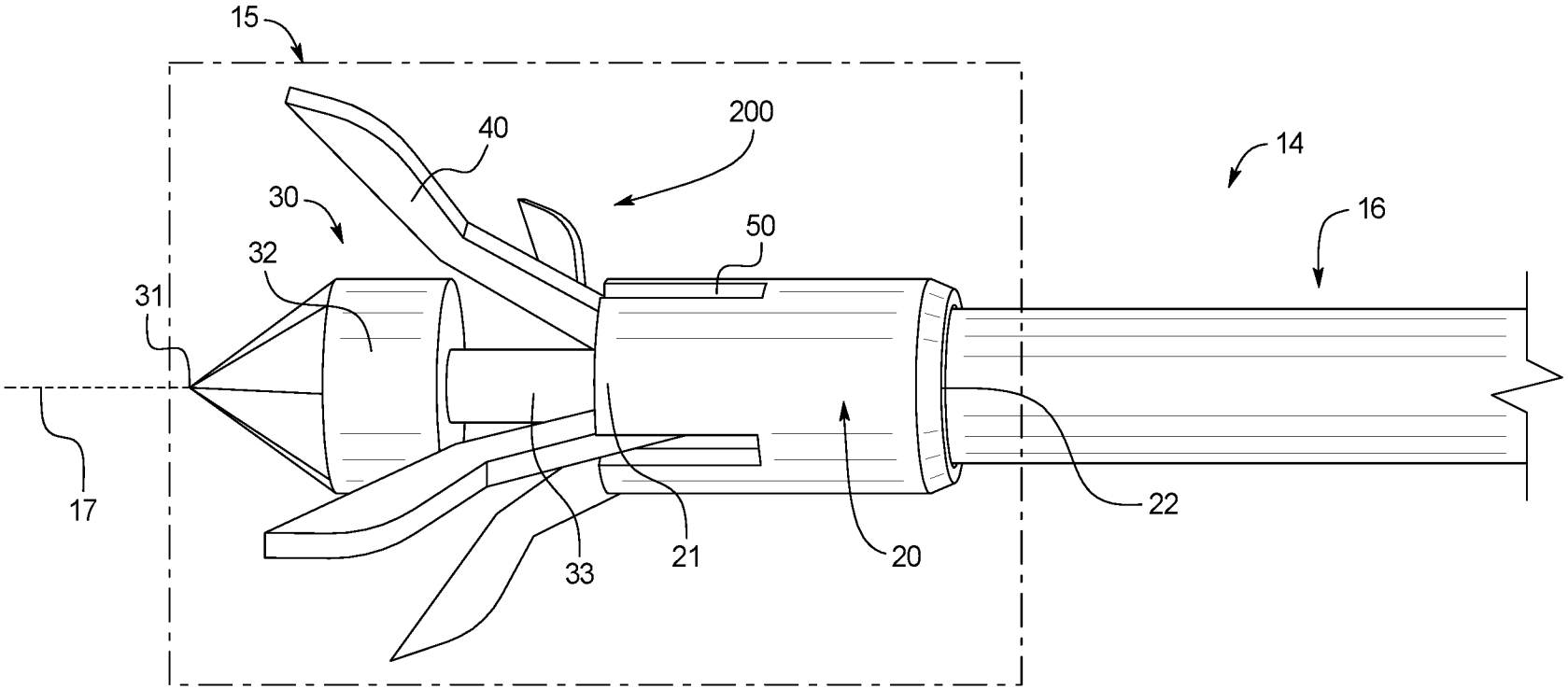
FIG. 10 is a side perspective view of the arrowhead of FIG. 8 illustrating the barbs in a removal position.
Figure 11:
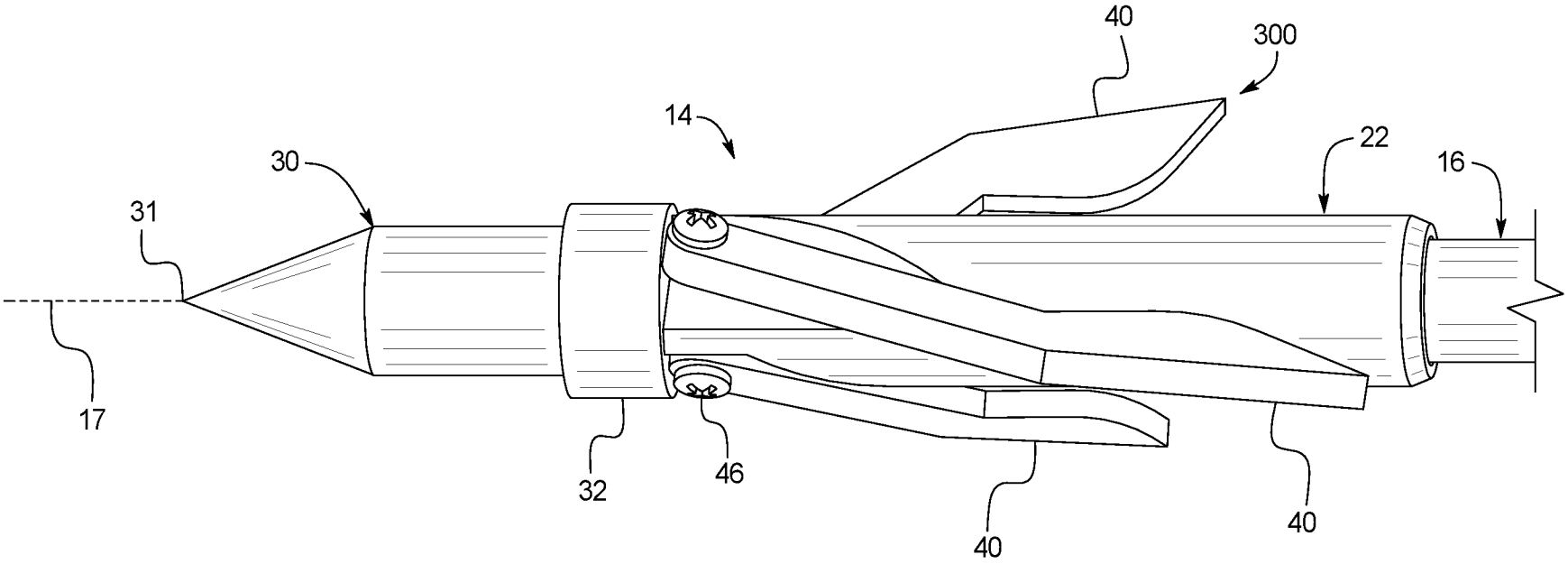
FIG. 11 is a side perspective view of yet another embodiment of an arrowhead with barbs in a firing position.
Figure 12:
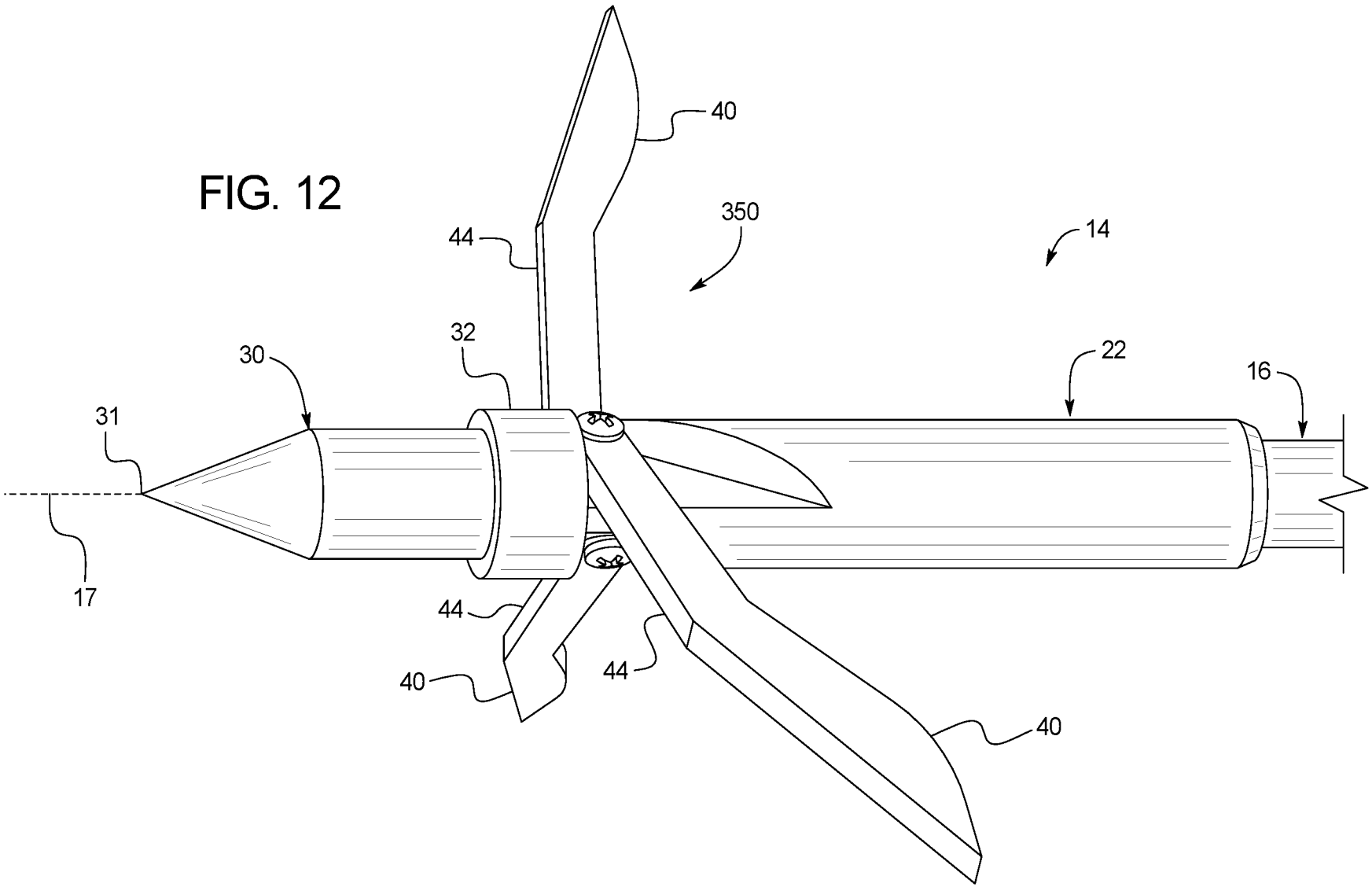
FIG. 12 is a side perspective view of the arrowhead of FIG. 1 lillustrating the barbs in a deployed position.
Figure 13:
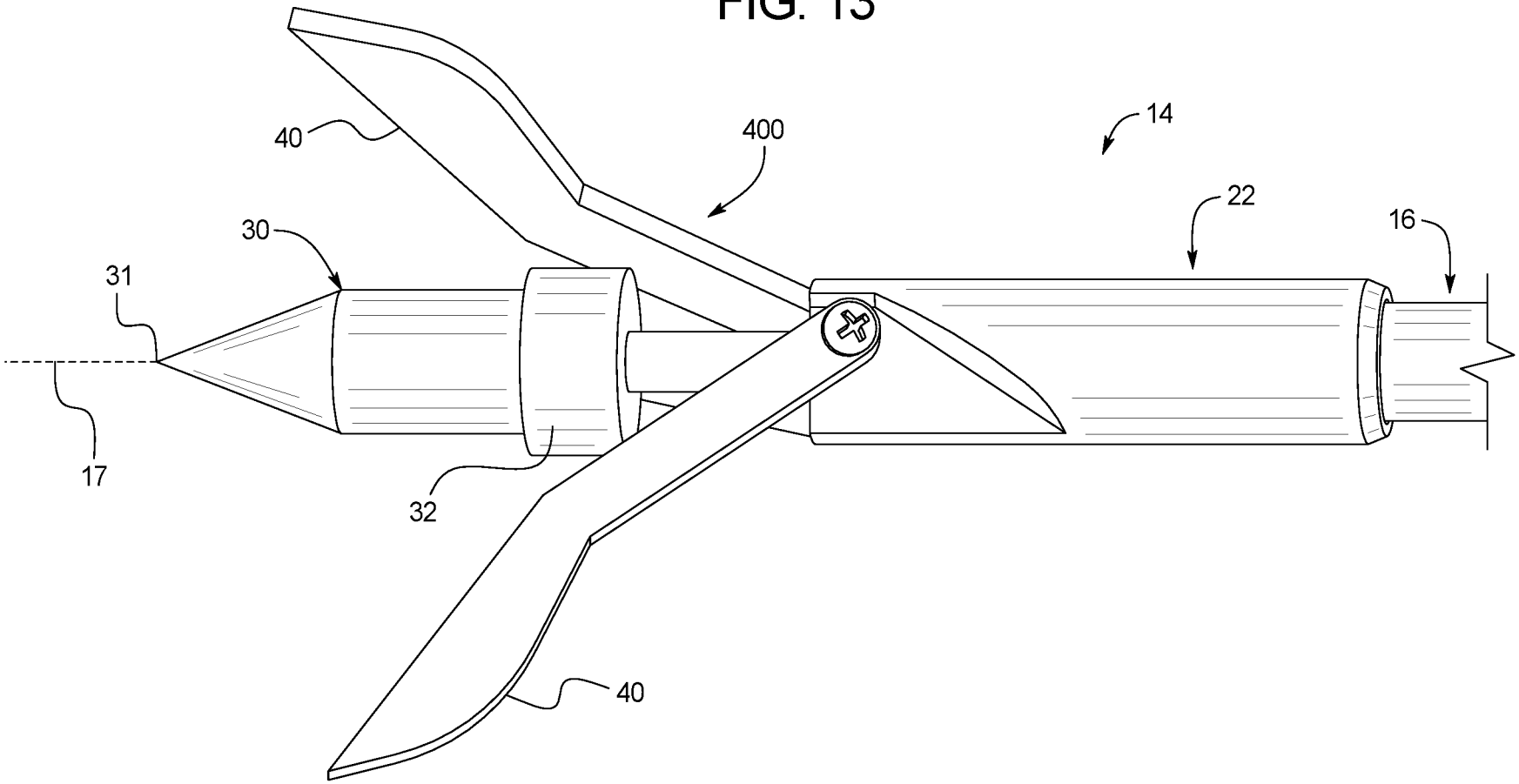
FIG. 13 is a side perspective view of the arrowhead of FIG. 11 illustrating the barbs in a removal position.

FIGS. 8, 9 and 10 illustrate another possible embodiment of the present invention. And, FIGS. 11, 12 and 13 illustrate a further embodiment of the present invention similar to the embodiment of FIGS. 8, 9, and 10. FIGS. 8 and 11 illustrate the arrowhead 15 and the barbs 40 of the embodiments in a firing position. FIGS. 9 and 12 illustrates the arrowhead 15 and the barbs 40 of the embodiments in a deployed position. FIGS. 10 and 13 illustrates the arrowhead 15 and the barbs 40 of the embodiments in a removal position 400.

As shown in FIG. 8-13, the arrowhead 15 includes an arrowhead body 20 and an arrow tip 30. In contrast with the embodiment of FIGS. 1-5, in the embodiments of FIGS. 8 13, the barbs 40 held in a deployed position by the arrow tip 30 and are permitted to move to a removable position 400 by using the toggle 72 to extend the arrow tip 30 away from the arrowhead body 20 to permit the barbs 40 to move freely.

The arrowhead body 20 provides a front end 21 and back end 22. The arrowhead body 20 may be made from fiberglass, aluminum, carbon fiber, or carbon fiber reinforced fiberglass. The arrowhead back end 22 may attach to an arrow shaft 16.

The arrowhead body 20 may provide for one or more angled barbs 40. The outside edge of the arrowhead body 20 may provide for one or more axial slots 50, which are formed in the arrowhead body 20. The arrowhead body 20 may include an identical number of barbs 40 and slots 50.

The arrow tip 30 includes a penetrating point 31 and a base portion 32. The arrow tip base portion 32 may be generally cylindrical in shape. The arrow tip penetrating point 31 is generally aligned with the arrow axis 17. The arrow tip 30 provides an arrow shaft 33 that protrudes from the arrow tip base portion 32 and travels along the arrow axis into the arrowhead body 20 through the arrow shaft 16. The arrow tip 30 may be moved along the arrow axis 17 by the toggle piston 76 as controlled by the user using the toggle 70.

FIGS. 8 and 11 illustrates the arrowhead 15 in the firing position 300. In the firing position 300, the arrow tip base portion 32 is flush with the arrowhead body front end 21 such that generally no space exists between the arrow tip 30 and arrowhead body 20. The tip base portion 32 acts to limits the rotational movement of the barbs 40. When the arrowhead 15 is fired and penetrates a fish, the barbs 40 may generally stay in the firing position 300. When a struggling fish tries to back off the arrow, the tissue of the fish will engage the beveled surfaces 42 of the barbs 40 causing them to pivot away from the arrow axis 17 to a fully deployed position 350 as shown in FIGS. 9 and 12. Upon rotating into the fully deployed position 350, the upper surfaces 44 of the barbs 40 may confront the base portion 32 thus preventing the barbs 40 from rotating any further than the deployed position 350.

The barbs 40 may pivotally move between various configurations as controlled by the toggle 72. For example, the barbs 40 may be locked in a first configuration when the toggle 72 is in deployed toggle position 101. In the first configuration, the barbs 40 may freely move between a firing position 300 and a deployed position 350 but may not move into a removable position 400. After the arrow is fired into a fish, the action of the struggling fish may force the barbs 40 into the deployed position 350, whereupon the deployed barbs 40 prevent the arrowhead 15 from being withdrawn from the fish.

To remove the arrowhead 15, a user may move the toggle 72 to a removable toggle position 201 to permit the barbs to move into a second configuration. The toggle 72 may be mechanically linked to the arrow tip 30 by the toggle piston 76. When the user moves the toggle 72 to the toggle position 201, the toggle piston 76 causes the arrow tip 30 to move away from the arrowhead body 20 opening a space to permit the barbs 40 to move into in a second configuration. Specifically, as the user draws the arrow 14 out of the fish, the resistance of the flesh forces the barbs 40 to pivot further forward into a removal position 400.

In an embodiment, the barbs 40 may be rotatably attached to the arrowhead body 20 at pivots 46 using a pin, such as a spring pin. Each barb vane 40 may include a first end and a second end, with the first end attached to the pivot 46. The various positions of the barbs 40 may be distinguished by the angles of the barbs 40 with respect to the arrow axis 17. More specifically, for a barb vane 40, an angle may be defined by a ray of the pivot to the second end and the ray of the pivot to the arrow shaft. The pivots 46 may be the vertexes of the angles. When the barbs 40 are in the firing position 300, the angle may be acute as shown in FIG. 11. When the barbs 40 are in the deployed position 350, the angle may be a right angle as shown in FIG. 12. And when the barbs 40 are in the removable position 400, the angle may be obtuse. More generally, in an embodiment, the barb vanes may be moved from a first configuration to a second configuration, where the angle of the first configuration is less than the angle of the second configuration.

In the embodiment shown in FIGS. 8-13, the toggle 72 of FIGS. 6 and 7 may be inverted along the arrow axis 17 to permit for correct functioning. Specifically, for the embodiment of FIGS. 1-5, the retraction of the toggle piston 76 is necessary to place the barbs 40 in the retracted position 200 for removal. Conversely, in the embodiments shown in FIGS. 8-13, the extension of the toggle piston 76 is necessary to place the barb vanes in the removal position 400 for removal.

FIGS. 10 and 13 illustrate the arrowhead in the removal position 400. In the removal position 300, the arrow tip 30 is pushed forward, via a manipulation of the toggle 72, along the arrow axis 17 such that the toggle piston 76 is exposed and the back portion of the arrow tip 32 is no longer in contact with the arrow body front end 21. As illustrated in FIGS. 10 and 13, the space created between the arrow tip 30 and the arrow body 20 gives the barbs 40 space to angle more towards the penetrating tip 31 than the arrow shaft 17, thus making it easier to remove the arrow head 15 from the target fish.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. An arrow comprising:

an arrow shaft including a toggle slot having a first portion extending in a first direction and a second portion extending from an end of the first portion in a second direction different from the first direction;

an arrowhead body including a front end and a hack end, wherein the arrow shaft is attached to the hack end of the arrowhead body;

a plurality of barbs pivotably connected to the arrowhead body;

an arrow tip including a penetrating point and a base, wherein the front end of the arrowhead body is located closer to the base than to the penetrating point;

a toggle piston attached to the arrow tip, wherein the toggle piston is linearly moveable within the arrow shaft and the arrowhead body; and a toggle attached to the toggle piston and extending through the toggle slot of the arrow shaft, wherein the toggle may be selectively positioned within one of the first portion and the second portion of the toggle slot;

wherein, when the toggle is positioned within the first portion of the toggle slot, the base of the arrow tip is located relative to the arrowhead body such that it restricts a pivoting movement of the plurality of barbs towards the penetrating point to a first degree of movement;

wherein, when the toggle is positioned within the second portion of the toggle slot, the base of the arrow tip is located further from the arrowhead body than when the toggle is positioned within the toggle slot first position such that it restricts the pivoting movement of the plurality of barbs towards the penetrating point to a second degree of movement that is greater than the first degree of movement.

2. The arrow of claim 1, wherein the plurality of barbs are angled barbs.

3. The arrow of claim 1, wherein the arrowhead body further includes a plurality of slots within which the barbs are located.

4. The arrow of claim 1, wherein each of the plurality of barbs form an angle in relation to the arrowhead body, wherein when the toggle is positioned within the toggle slot first position the angle is ninety degrees of less and when the toggle is positioned within the toggle slot first position, the angle is greater than ninety degrees.

5. The arrow of claim 1, wherein the toggle is located at approximately the midpoint of the arrow shaft.

6. The arrow of claim 1, wherein the toggle is located on the arrow shaft between two to four inches distal from the arrowhead.

* * * * *